US012729674B2

(12) United States Patent
Dreiling

(10) Patent No.: US 12,729,674 B2
(45) Date of Patent: Sep. 8, 2026

(54) MULTI-REAGENT PERISTALTIC PUMP DISPENSING

(71) Applicant: Hach Company, Loveland, CO (US)

(72) Inventor: Brian J. Dreiling, Windsor, CO (US)

(73) Assignee: HACH COMPANY, Loveland, CO (US)

( * ) Notice: Subject to any disclaimer, the term of this patent is extended or adjusted under 35 U.S.C. 154(b) by 6 days.

(21) Appl. No.: 18/969,900

(22) Filed: Dec. 5, 2024

(65) Prior Publication Data

US 2026/0160240 A1 Jun. 11, 2026

(51) Int. Cl.
*F04B 43/00* (2006.01)
*F04B 43/08* (2006.01)
*F04B 43/12* (2006.01)

(52) U.S. Cl.
CPC ..... *F04B 43/0081* (2013.01); *F04B 43/0045* (2013.01); *F04B 43/086* (2013.01); *F04B 43/123* (2013.01)

(58) Field of Classification Search
CPC F04B 43/0045; F04B 43/123; F04B 43/0081; F04B 43/086; B01L 2300/088
See application file for complete search history.

(56) References Cited

U.S. PATENT DOCUMENTS 2,797,149 A * 6/1957 Skeggs ..... G01N 35/08 436/95
2,853,024 A * 9/1958 Bruce ..... F04B 43/08 92/73
3,622,251 A * 11/1971 Allen ..... F04B 43/0045 417/571
3,816,033 A * 6/1974 Fried ..... F04B 43/1292 417/477.2
3,953,136 A * 4/1976 Hach ..... G01N 21/03 436/103
4,228,930 A * 10/1980 Hogan ..... F04B 43/1284 417/477.3
4,365,943 A * 12/1982 Durrum ..... F04B 43/086 417/478
4,441,867 A * 4/1984 Berelson ..... F04B 43/1292 417/477.1
4,559,040 A * 12/1985 Horres ..... F04B 43/123 417/474
4,673,334 A * 6/1987 Allington ..... F04B 43/1292 417/477.2

(Continued)

FOREIGN PATENT DOCUMENTS

GB 1432113 A * 4/1976 ..... F04B 43/082
WO WO-9911933 A1 * 3/1999 ..... F04B 43/1292

(Continued)

*Primary Examiner* — Christopher S Bobish
(74) *Attorney, Agent, or Firm* — Ference & Associates LLC

(57) ABSTRACT

An embodiment provides a method for moving precise volumes of fluid using a linear peristaltic pump, including: operating the pump for a first portion of a pump cycle, wherein the operating the first portion dispenses a first reagent, wherein the pump comprises a motor and a cam; pausing the pump for a period of time; and operating the pump for a second portion of the pump cycle, wherein the operating the second portion dispenses a second reagent. Other aspects are described and claimed.

20 Claims, 4 Drawing Sheets

(56) References Cited

U.S. PATENT DOCUMENTS

| | | | | | |
|---|---|---|---|---|---|
| 4,886,431 | A * | 12/1989 | Soderquist | F04B 43/1292 | 604/153 |
| 5,649,808 | A * | 7/1997 | Gruszecki | F04B 43/1253 | 417/63 |
| 6,033,060 | A * | 3/2000 | Minami | B41J 2/1707 | 347/85 |
| 7,942,654 | B2 * | 5/2011 | Chang | F04B 43/0072 | 417/474 |
| 11,421,672 | B2 | 8/2022 | Vin Raviv et al. | | |
| 2003/0143754 | A1 * | 7/2003 | Lum | F04B 43/1223 | 436/180 |
| 2009/0035165 | A1 * | 2/2009 | Chang | F04B 43/0072 | 417/477.2 |
| 2011/0033318 | A1 * | 2/2011 | Ramirez, Jr. | F04B 43/1292 | 417/321 |
| 2016/0208792 | A1 * | 7/2016 | Miyamoto | F04B 43/09 | |
| 2020/0003197 | A1 * | 1/2020 | Colavincenzo | F04B 1/0413 | |
| 2020/0038863 | A1 * | 2/2020 | Haupt | B01L 3/50273 | |
| 2020/0197934 | A1 * | 6/2020 | Amshey | B01L 3/50273 | |
| 2021/0121874 | A1 * | 4/2021 | Rothberg | F04B 13/00 | |
| 2021/0172431 | A1 * | 6/2021 | Vin Raviv | F04B 13/00 | |

FOREIGN PATENT DOCUMENTS

| | | | | | |
|---|---|---|---|---|---|
| WO | WO-0003141 | A1 * | 1/2000 | F04B 35/01 | |
| WO | WO-2014198498 | A1 * | 12/2014 | F01N 3/2066 | |
| WO | WO-2021113057 | A1 * | 6/2021 | F04B 13/00 | |
| WO | WO-2022086981 | A1 * | 4/2022 | B01L 7/52 | |

* cited by examiner

| Cam Configuration | | | | | | | | | | | | | | | |
|---|---|---|---|---|---|---|---|---|---|---|---|---|---|---|---|
| | | | | | | | | | | | | | | | |
| pump position | 1 | 2 | 3 | 4 | 5 | 6 | 8 | 9 | 10 | 11 | 12 | 13 | 14 | 15 | 16 |
| cam lobe 1 | 0 | 1 | 1 | 1 | 0 | 0 | 0 | 0 | 0 | 0 | 0 | 0 | 0 | 0 | 0 |
| cam lobe 2 | 0 | 0 | 0 | 1 | 1 | 0 | 0 | 1 | 1 | 1 | 1 | 1 | 1 | 0 | 0 |
| cam lobe 3 | 0 | 0 | 0 | 0 | 1 | 1 | 1 | 1 | 0 | 0 | 0 | 0 | 1 | 1 | 1 |
| cam lobe 4 | 1 | 1 | 0 | 0 | 0 | 1 | 0 | 0 | 0 | 1 | 1 | 0 | 0 | 0 | 1 |
| cam lobe 5 | 0 | 0 | 0 | 0 | 0 | 0 | 0 | 0 | 0 | 0 | 1 | 1 | 0 | 0 | 0 |
| cam lobe 6 | 1 | 1 | 1 | 1 | 1 | 1 | 1 | 1 | 0 | 0 | 0 | 1 | 1 | 1 | 1 |
| | | | | | | | | | | | | | | | |
| tube compressed at cam position | | | | | | | | | | | | | | | |
| | | | | | | | | | | | | | | | |
| reagent 1 block 1 | FALSE | TRUE | TRUE | TRUE | FALSE | FALSE | FALSE | FALSE | FALSE | FALSE | FALSE | FALSE | FALSE | FALSE | FALSE |
| reagent 1 block 2 | FALSE | FALSE | FALSE | TRUE | TRUE | FALSE | FALSE | TRUE | TRUE | TRUE | TRUE | TRUE | TRUE | FALSE | FALSE |
| reagent 1 block 3 | FALSE | FALSE | FALSE | FALSE | TRUE | TRUE | TRUE | TRUE | FALSE | FALSE | FALSE | FALSE | TRUE | TRUE | TRUE |
| reagent 1 block 4 | TRUE | TRUE | FALSE | FALSE | FALSE | TRUE | FALSE | FALSE | FALSE | TRUE | TRUE | FALSE | FALSE | FALSE | TRUE |
| reagent 1 block 5 | FALSE | FALSE | FALSE | FALSE | FALSE | FALSE | FALSE | FALSE | FALSE | FALSE | FALSE | FALSE | FALSE | FALSE | FALSE |
| reagent 1 block 6 | FALSE | FALSE | FALSE | FALSE | FALSE | FALSE | FALSE | FALSE | FALSE | FALSE | FALSE | FALSE | FALSE | FALSE | FALSE |
| | | | | | | | | | | | | | | | |
| | | | | | | | | | | | | | | | |
| reagent 2 block 1 | FALSE | FALSE | FALSE | FALSE | FALSE | FALSE | FALSE | FALSE | FALSE | FALSE | FALSE | FALSE | FALSE | FALSE | FALSE |
| reagent 2 block 2 | FALSE | FALSE | FALSE | TRUE | TRUE | FALSE | FALSE | TRUE | TRUE | TRUE | TRUE | TRUE | TRUE | FALSE | FALSE |
| reagent 2 block 3 | FALSE | FALSE | FALSE | FALSE | FALSE | FALSE | FALSE | FALSE | FALSE | FALSE | FALSE | FALSE | FALSE | FALSE | FALSE |
| reagent 2 block 4 | TRUE | TRUE | FALSE | FALSE | FALSE | TRUE | FALSE | FALSE | FALSE | TRUE | TRUE | FALSE | FALSE | FALSE | TRUE |
| reagent 2 block 5 | FALSE | FALSE | FALSE | FALSE | FALSE | FALSE | FALSE | FALSE | FALSE | FALSE | TRUE | TRUE | FALSE | FALSE | FALSE |
| reagent 2 block 6 | TRUE | TRUE | TRUE | TRUE | TRUE | TRUE | TRUE | TRUE | FALSE | FALSE | FALSE | TRUE | TRUE | TRUE | TRUE |
| | | | | | | | | | | | | | | | |
| | | | | | | | | | | | | | | | |
| | fill 1 | close 1 | open 1 to cell | dose 1 | | close 1 | fill 2 | close 2 | open 2 to cell | dose 2 | | close 2 | return to start and refill | | |

FIG. 2

MULTI-REAGENT PERISTALTIC PUMP DISPENSING

FIELD

This application relates generally to pumps, and, more particularly, to peristaltic pumps.

BACKGROUND

Peristaltic pumps may be used to pump fluids. The fluid may be in a tube. The pump may compress the tube and cause the movement of fluid through the tube. Peristaltic pumps may be used in medical, agricultural, industrial, laboratory, food preparation, or the like. The movement of fluid in the tube may be controlled by the peristaltic pump. The movement may be metered such that an amount of the fluid is moved. A peristaltic pump may be used in an environment in which air or turbulence cannot be introduced into the fluid.

BRIEF SUMMARY

In summary, one embodiment provides a method for moving precise volumes of fluid using a linear peristaltic pump, comprising: operating the pump for a first portion of a pump cycle, wherein the operating the first portion dispenses a first reagent, wherein the pump comprises a motor and a cam; pausing the pump for a period of time; and operating the pump for a second portion of the pump cycle, wherein the operating the second portion dispenses a second reagent.

Another embodiment provides a device for delivering a precise volume of fluid using linear peristaltic pump, comprising: a motor; a cam; a motor controller; a processor; a memory device that stores instructions that, when executed by the processor, causes the system to: operate the pump, using the motor controller, for a first portion of a pump cycle, wherein the operating the first portion dispenses a first reagent; pause the pump, using the motor controller, for a period of time; and operate the pump, using the motor controller, for a second portion of the pump cycle, wherein the operating the second portion dispenses a second reagent.

A further embodiment provides a product for delivering a precise volume of fluid using a linear peristaltic pump, comprising: a computer-readable storage device that stores executable code that, when executed by a processor, causes the product to: code that operates the pump, using a motor controller, for a first portion of a pump cycle, wherein the operating the first portion dispenses a first reagent; code that pauses the pump, using the motor controller, for a period of time; and code that operates the pump, using the motor controller, for a second portion of the pump cycle, wherein the operating the second portion dispenses a second reagent.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

BRIEF DESCRIPTION OF THE SEVERAL VIEWS OF THE DRAWINGS

FIG. 2 illustrates an example reagent dispensing profile of a peristaltic pump.

DETAILED DESCRIPTION

Figure 1:
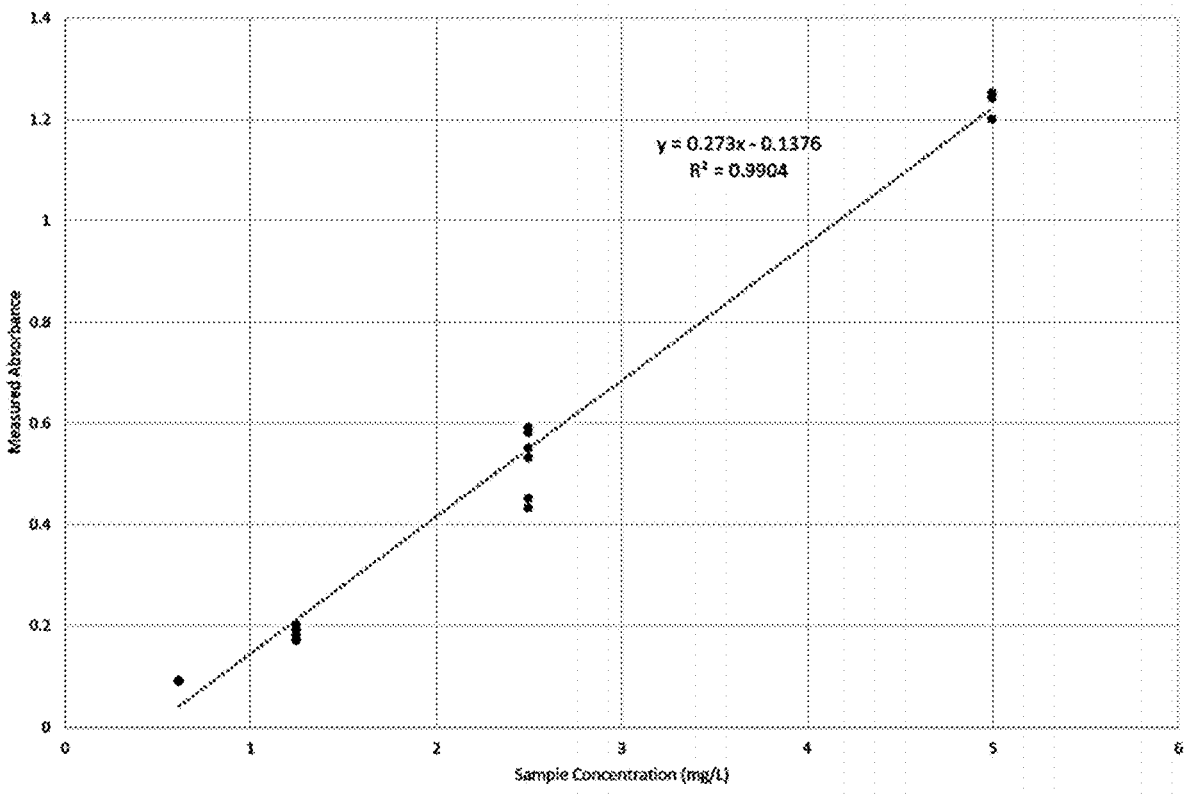
FIG. 1 illustrates an example data of absorbance versus sample concentration of a parameter measured with a two step reagent dispensing peristaltic pump.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well-known structures, materials, or operations are not shown or described in detail. The following description is intended only by way of example, and simply illustrates certain example embodiments.

Conventional methods and systems for peristaltic pumps may be of the roller type. A fluid may be contained in a flexible tube. A fluid may be moved or displaced by movement of a roller against the flexible tube. For example, a flexible tube containing a fluid may be wrapped around a roller. The roller on the outside circumference of a shaft turns and compresses the tube and the fluid contained therein. As the roller turns, a portion of the tube becomes compressed, partially occluded, or occluded. The tube may then return to an uncompressed state after the roller passes. The roller may be switched on and off to deliver an amount of fluid.

A linear peristaltic pump uses another method to compress a tube and fluid contained therein. A series of compressions against the tube in an inline manner, as opposed to a rotating roller, creates movement of fluid through the tube. Linear peristaltic pumps may allow for a higher precision of delivery of a measured volume of fluid. In other words, a series of compression against the tubing in a sequential manner may move the fluid through the tube.

Conventional peristaltic pumps may provide a means to pinch a tube or more than one tube placed in a contact portion of the peristaltic pump. However, such a configuration moves the fluid in the tube or tubes in a similar manner. In other words, the tubes laid upon a contact surface of the pump either is pumped or moved at the same time. If an application requires moving different fluids at different times, volumes, or the like, more than one peristaltic pump would be required. What is needed is a peristaltic pump that may move different fluids at different times. Each fluid movement may be of a similar or varying volumes.

Accordingly, an embodiment provides a device and method for the precise delivery of two or more fluids in tubes using a linear peristaltic pump. In particular, the peristaltic pump may have contact surfaces or lobes that contact different tubes each with a fluid, and move each fluid at its own rate, time, volume, or the like. In other words, a single pump may move different fluids or reagents contained in each tube in a controlled manner unique to the tube. For example, the pump may dispense a first reagent, pause, and then restart and dispense a second reagent. A reagent may each be a single reagent or two or more reagents. A pump cycle for a first and second dispensing of reagents may be a single rotation of the motor and associated blocks or contact points of the pump upon the fluid containing tubes. The peristaltic pump may have a plurality of compression blocks and may contain one or more pinch blocks. A face end of the compression block may compress the tube to move the fluid within the tube. A face end of a pinch block may partially occlude or occlude the tubing and stop flow. In an embodiment, the compression and pinch blocks may slide in a slide area of a housing. The sliding of the block may be in a longitudinal axis from the face end to a base end of the block. The base end of a compression or a pinch block may contact a cam that moves a block in a track or grove.

The illustrated example embodiments will be best understood by reference to the figures. The following description is intended only by way of example, and simply illustrates certain example embodiments.

In an embodiment, a measurement of water quality parameters requires dispensing reagents at several different times during the measurement cycle. For example, conventional linear peristaltic pumps, such as the CL17 linear peristaltic pump (available from Hach Company, Loveland CO USA) can only dispense the reagents at one time during the measurement cycle. If a further dispensing is required, one or more additional pumps are required. In an embodiment, the design of the pump it can dispense the reagents at two or more different times during the measurement cycle using only one motor (or pump) for reagent dispensing.

In an embodiment, the peristaltic pump allows different reagents to be dispensed at two or more different times. The separation of the timing or period of time may allow for chemistry in a reaction to take place. In other words, a measurement may require the precise delivery of one or more reagents, a period of time to pass to allow the first set to reacts, and then a second set of one or more reagents to be dispensed or added to the reaction or reaction chamber.

In an embodiment, the peristaltic pump may have one motor and be one pump, and one turn or revolution with a pause between reagent sets allows for the dispensing of multiple reagent sets to be dispensed by the one pump and motor with one revolution of the cam. In other words, a single revolution or a 360 degree rotation of the cam performs the dispensing of the multiple reagents groups with a pause built in for a reaction to take place. The motor may be a stepper motor. The method and device may comprise a switch or sensor to determine a position of the motor. The method and device may have a controller for the motor. The motor controller may be a switch, solenoid, circuitry operatively coupled to a stepper motor, or the like. In other words, a sensor or switch may determine the position of the motor to allow accurate control of the cycle for multiple dispensing events. In an embodiment, about half or a portion of rotation dispenses a first reagent, pause, then half or balance of rotation dispense second set. As another example, the rotation of the cam may not be exactly half. For example, the rotation of the cam may be 220 degrees for a first reagent set and 140 degrees for a second reagent set. Each tube of each reagent contacts different pump blocks driven by lobes on a cam. In another embodiment, a full rotation of the cam may be broken into further portions. The exemplars use two dispensing events, however, this may be three or more dispensing events.

The sample delivery may be moved to an external sample valve instead of using the cam based valve in one embodiment as is done on the existing Hach CL17 pump (available from Hach Company, Loveland CO, USA), however it can be moved back to the reagent pump with a different cam and pump block configuration.

In an embodiment, the pump uses a single stepper motor. In an embodiment, the pump may use an optical break beam to find the home, the stop point between reagents dispenses, or the stop point of all dispense steps. The sample is now dispensed with a sample valve. The sample may refer to a volume of a water sample with a parameter to be measured. The pump can be configured to dispense reagents with the following configurations as examples. The pump may dispense 1 reagent, wait, and dispense another 1 reagent. The pump may dispense 1 reagent, wait, and dispense another 2 reagents. The pump may dispense 2 reagents, wait, and dispense another 1 reagent. The pump may dispense 2 reagents, wait, and dispense another 2 reagents. These examples are illustrative and not exhaustive. For example, the pump may dispense more than two reagent sets, and may dispense any number of reagents per reagent sets. A configuration of the pump regarding size, cam shape to move blocks, and number of blocks may provide a pump to dispense multiple reagent sets with pausing periods of time in between.

Referring to FIG. 1, in an embodiment, an example measurement of a reagent in a water quality sample using the multi-reagent peristaltic pump is illustrated. This is an example of a use for the pump described herein, but it not limiting. The pump may be used for any reaction in which a single pump with a pause in reagent dispensing is used. An absorbance versus sample concentration for nitrate ($NO_3$) is illustrated. The measurement of nitrate may be referred to as a measurement parameter. For example, the sample may be flushed. Then dark and blank measurements may be performed. Then the peristaltic pump may dispense both hydrazine and sodium hyperchloride to the reaction chamber as a first reagent. At this point the peristaltic pump may pause. In other words, the pump, and associated motor and cam, may pause at a point partially through a single rotation to allow time to pass. This time allows a reaction to take place. In this example, the pump pauses for 10 minutes to allow $NO_3$ to be digested into $NO_2$.

Then the pump dispenses a sulfamide reagent, pauses for another 2 minutes or more to allow color in the reaction to develop, and then absorbance can be measured. In this example, heat may also be applied to a measurement cell. The apparatus may use separate valve for reagents or samples, use a solenoid, use switch/timer to start and stop pump or motor, or to open/close associates valves. The pump may be coupled via tubing and controlled by a processor coupled to both the pump and colorimeter. The example shown measures nitrite, but other reagent measurement such as silica or free ammonia are tested and disclosed.

Referring to FIG. 2, in an embodiment a chart of cam profiles is illustrated. In other words, the chart illustrates tube compression of reagents given the pump position and associated cam lobe. The single pump is capable of dispensing multiple reagents or reagent sets with a time pause. As an example, a "1" or "true" denotes a pinch of the tube with a regent being compressed and thus move or dispensed by the peristaltic pump.

Figure 3:
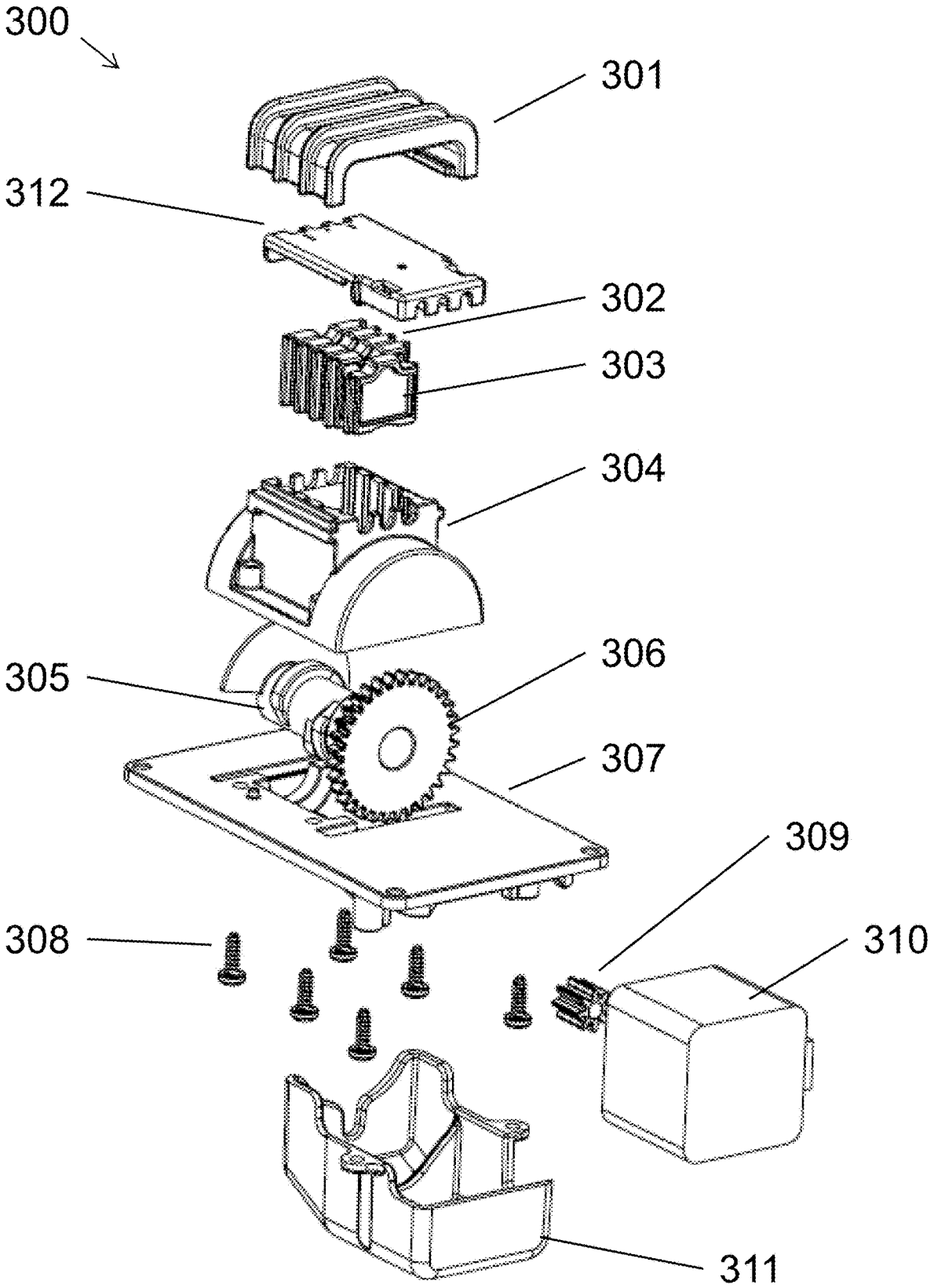
FIG. 3 illustrates an example embodiment of a peristaltic pump.

Referring to FIG. 3 is provided as an example cutaway view of an embodiment of the peristaltic pump. The device 300 may be used the movement of a fluid contained in a tube. The peristaltic pump may be used for medical, industrial, laboratory, agricultural, or the like environments. The peristaltic pump may use a plurality of blocks that contact and compress the tube in a sequence to facilitate the movement of a fluid through the tube.

The peristaltic pump may have a cover 301. The cover may be a cover for a slide area of the housing 304. The cover 301 may have a functional purpose. For example, the cover 301 may be removable and serve as a clamp to keep at least one piece of tubing (not pictured) in contact with a plurality of compression blocks 302 and/or an at least one pinch block 303. The tubing may be of a compressible material. The cover 301 may snap or slide into place upon the slide area of a housing 304. Additionally or alternatively, the cover 301 may be affixed with a hinge, latch, fastener, or the like. The cover 301 may snap, swing, click, or the like into a closed position. The cover 301, may be easily opened to allow at least one length of tubing to be placed under the cover. The cover 301, may apply enough force to the tubing to keep it against the plurality of compression blocks 302 and the pinch block 303 if present. The force may be gentle enough such that the at least one piece of tubing is not crimped and/or constricted by the cover 301. In an embodiment, the pump may have a tubing cartridge 312. The tubing cartridge 312 may hold one or more tubes, may allow for easier changing of tubing, and/or align one or more pieces of tubing. The tubing cartridge 312 may be located between the cover 301, and the plurality of compression blocks 302 and the at least one pinch block 303 if present. In an embodiment, tubing cartridge 312 may have indentations aligned with indentations of the slide area of a housing 304 to hold one or more pieces of tubing in place against the faces of the plurality of compression blocks 302 and the at least one pinch block 303 if present. The cover 301 may hold the tubing cartridge 312 in place.

The peristaltic pump may have a plurality of compression blocks 302. The compression block may have a face end and a base end. The face end may be in contact or opposed to at least one piece of tubing. The base end of a compression block may be in contact with or opposed to a cam 305. The face end of a compression block 302 may be shaped or contoured. For example, the face of a compression block 302 may have a semicircular indentation. The semicircular indentation may be beveled around the edges. The semicircular indentation may be of a diameter corresponding to a diameter of a piece of tubing or similar to a piece of tubing. A compression block 302 may be shaped such that the face end compresses the tubing.

A plurality of compression blocks may be present. For example, a plurality of compression blocks may be parallel to one another. The face end of each compression block may compress the tubing in a sequence to facilitate movement of a fluid in a tube. The plurality of compression blocks may move in a sequence or in a different order to cause peristalsis of fluid through the tube. The sequence may be from one compression block to an adjacent block and so forth. Other sequences are possible depending on the use or application of the peristaltic pump.

The peristaltic pump may have at least one pinch block 303. In an embodiment there may be only a single pinch block. The pinch block may stop the flow of a fluid in a tube. The stoppage of fluid may be at a time when the pump is turned off. The pinch block 303 may have a face end and a base end. The face end of a pinch block may be in contact or opposed to at least one piece of tubing. The base end of a pinch block may be in contact with or opposed to a cam 305. The face end of a compression block may be shaped or contoured. For example, the face of a pinch block may have a raised portion on the face end. The raised portion may be beveled around the edges. The raised portion may have dimensions corresponding to a diameter of a piece of tubing or similar to a piece of tubing. A pinch block 303 may be shaped such that the face end compresses and/or occludes the tubing. The pinch block 303 may be retractable. In other words, the pinch block 303 may be moved such that the face end does not contact the tubing while the peristaltic pump is moving fluid through a tube. The pinch block 303 may be moved such that the raise portion occludes or stops the movement of a fluid in the tubing when the pump is stopped or when the flow is shut off.

The peristaltic pump may have a slide area of a housing 304. The slide area is a portion of the housing of the peristaltic pump. The plurality of compression blocks 302 and the at least one pinch block 303 if present, may be partially located in the slide area 304. The slide area 304, may have tracks or grooves. A single track or groove, has a corresponding compression or pinch block. As an analogy, the slide area 304 may be akin to a dresser, and the compression or pinch blocks akin to the drawers in the dresser. Each compression or pinch block may slide in its respective groove or track independently of one another. The number of slides or tracks may be adapted to the use or application of the peristaltic pump. The compression or pinch block may slide in its respective groove or track in an axis from the base end to the face end or each compression or pinch block.

At the base of the slide area 304, the peristaltic pump may have a cam 305. The cam 305 may contact the base end of the plurality of compression blocks 302 and may contact one or more pinch block 303 if present. The rotation of the cam 305 around its longitudinal axis may cause the plurality of compression blocks 302 and the at least one pinch block 303 if present to slide in the slide are 304. The sliding of the plurality of compression blocks 302 and the at least one pinch block 303 if present, in turn, cause the face end of each of the plurality of compression blocks 302 and the at least one pinch block 303 if present to contact the tubing and move fluid through the tube.

The cam 305, may have lobes. Lobes may be raised portions away from the longitudinal centerline of the cam that correspond to each of the compression of pinch blocks. A cam 305 and associated lobes may be selected based upon the desired movement of the compression and pinch blocks. In other words, the lobes of the cam 305, may be indexed to raise and lower a block in a particular order and at a particular time. Different cams and lobe configurations may yield different peristaltic movement of fluid in the tube.

A spur gear 306 may be mechanically coupled to or molded with the cam 305. In other words, to reduce the number of pieces and complexity of the pump, the cam 305, lobes of the cam, spur gear 306, and other associated components may be a single molded piece. The spur gear 306 may mesh with a pinion gear 309. The pinion gear may be mechanically coupled to a motor 310. The number of teeth, diameter, and ratio of the spur 306 and pinion 309 gears may be selected for speed, precision, application, or the like of the peristaltic pump. Gear reduction may allow a smaller and cheaper motor to be used. The motor may be a stepper motor. The motor may have an extended service life as well. This configuration may also reduce the number of parts and moving parts as compared to a traditional peristaltic pump.

The peristaltic pump may have a mounting plate 307. The mounting plate may serve to attach the slide area 304 and the cam cover 311 together. Fasteners 308 such as screws, rivets, clips, bolts, plastic pieces, or the like may be used to hold the pieces together. The mounting plate 307 may also be used to place and mount the peristaltic pump a device. For example, the peristaltic pump may be a part of a larger device such as medical, laboratory, diagnostic, or the like equipment.

The system and method may determine the proper volume, rate of delivery, type of fluid, or like. The system may have flow sensors, fluid level sensors, pressure sensor, or any sensor to determine a volume or rate of flow of a fluid. Additionally or alternatively, the peristaltic pump may be calibrated. For example, the system may be programmed that given certain parameters, one cycle of the peristaltic pump delivers a certain volume of a fluid. The parameters may include tubing diameter, tubing compression, fluid viscosity, peristaltic pump speed, number of tubes, or the like. The sensors may be located upstream, downstream, or with in the peristaltic pump unit. The sensors may provide feedback to a system and/or the pump to regulate the delivery of a fluid. The system may also monitor and measure the flow of a plurality of tubes that may deliver fluid.

Measurement of the delivery of a fluid may be at periodic intervals set by the user or preprogrammed frequencies in the device. A measurement of the delivery of a fluid may be an output upon a device in the form of a display, printing, storage, audio, haptic feedback, or the like. Alternatively or additionally, the output may be sent to another device through wired, wireless, fiber optic, Bluetooth®, near field communication, or the like. An embodiment may use an alarm to warn of a measurement or fluid delivery outside acceptable levels. An embodiment may use a system to shut down the peristaltic pump or alter the peristaltic pumping during periods of unacceptable parameters, parameters, or thresholds. For example, a measuring device may use a relay coupled to an electrically actuated valve, or the like. As another example, the system and method may have an automated release of a clamp on the tubing. The automated release may be a solenoid, shift the cover, relax the tubing compression of the like. The automated release may release compression on one or more of the pieces of tubing, and may be activated when the system is stagnant for a period of time.

If the fluid delivery is outside acceptable parameters, the system may take corrective action. For example, the system may provide an input to the peristaltic pump to increase speed, increase volume, increase pressure, or the like. In an embodiment, a peristaltic pump may be switched to a faster pumping state to increase pressure, flow, volume, or the like.

Additionally or alternatively, the system may output an alarm, log an event, or the like. An alert may be in a form of audio, visual, data, storing the data to a memory device, sending the output through a connected or wireless system, printing the output or the like. The system may log information such as the measurement location, a corrective action, geographical location, time, date, number of measurement cycles, rate of flow, volume of fluid, a log of the type of fluid being delivered, or the like. The alert or log may be automated, meaning the system may automatically output whether a correction was required or not. The system may also have associated alarms, limits, or predetermined thresholds. For example, if fluid delivery reaches or falls below a threshold or limit. Alarms or logs may be analyzed in real-time, stored for later use, or any combination thereof.

The various embodiments described herein thus represent a technical improvement to conventional peristaltic pump techniques. Using the techniques as described herein, an embodiment may use a method and device for peristaltic pumps. This is in contrast to conventional methods with limitations mentioned above. Such techniques provide a better method to construct and operate peristaltic pumps.

Figure 4:
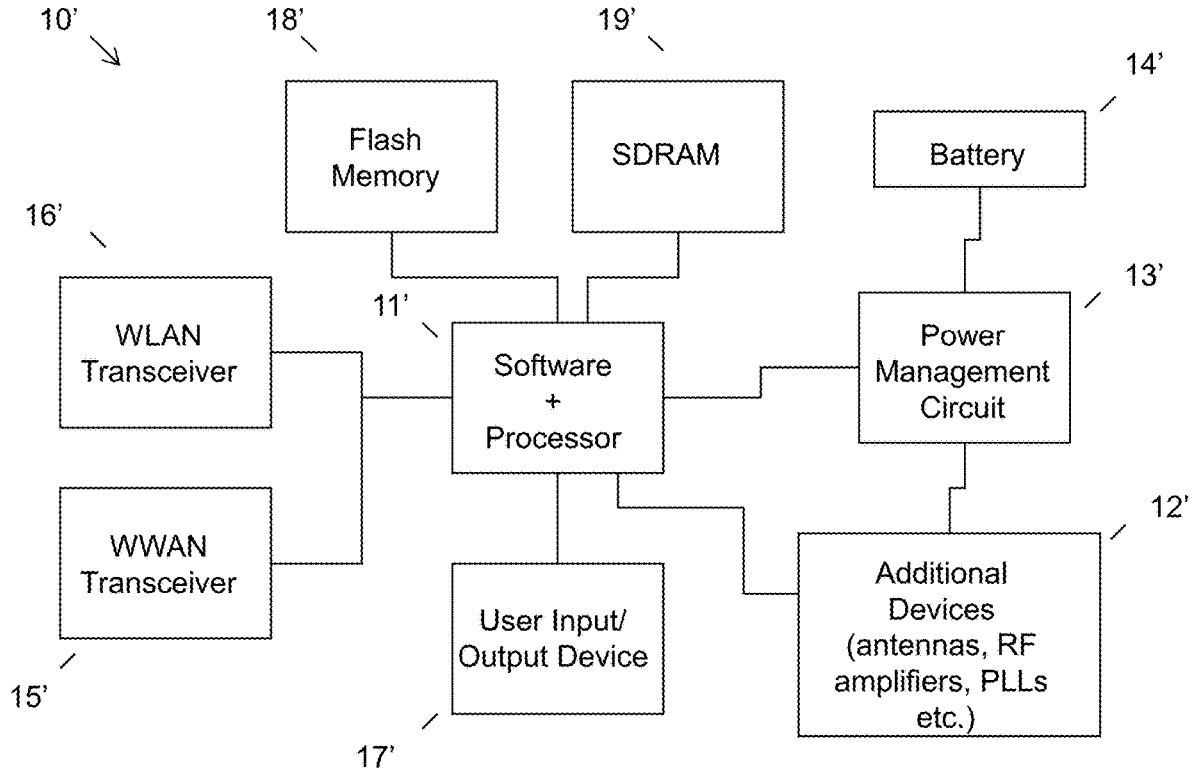
FIG. 4 illustrates an example of computer circuitry.

While various other circuits, circuitry or components may be utilized in information handling devices, with regard to a peristaltic pump according to any one of the various embodiments described herein, an example is illustrated in FIG. 4. Device circuitry 10' may include a measurement system on a chip design found, for example, a particular computing platform (e.g., mobile computing, desktop computing, etc.) Software and processor(s) are combined in a single chip 11'. Processors comprise internal arithmetic units, registers, cache memory, busses, I/O ports, etc., as is well known in the art. Internal busses and the like depend on different vendors, but essentially all the peripheral devices (12') may attach to a single chip 11'. The circuitry 10' combines the processor, memory control, and I/O controller hub all into a single chip 11'. Also, systems 10' of this type do not typically use SATA or PCI or LPC. Common interfaces, for example, include SDIO and I2C.

There are power management chip(s) 13', e.g., a battery management unit, BMU, which manage power as supplied, for example, via a rechargeable battery 14', which may be recharged by a connection to a power source (not shown). In at least one design, a single chip, such as 11', is used to supply BIOS like functionality and DRAM memory.

System 10' typically includes one or more of a WWAN transceiver 15' and a WLAN transceiver 16' for connecting to various networks, such as telecommunications networks and wireless Internet devices, e.g., access points. Additionally, devices 12' are commonly included, e.g., a transmit and receive antenna, oscillators, PLLs, etc. System 10' includes input/output devices 17' for data input and display/rendering (e.g., a computing location located away from the single beam system that is easily accessible by a user). System 10' also typically includes various memory devices, for example flash memory 18' and SDRAM 19'.

It can be appreciated from the foregoing that electronic components of one or more systems or devices may include, but are not limited to, at least one processing unit, a memory, and a communication bus or communication means that couples various components including the memory to the processing unit(s). A system or device may include or have access to a variety of device readable media. System memory may include device readable storage media in the form of volatile and/or nonvolatile memory such as read only memory (ROM) and/or random access memory (RAM). By way of example, and not limitation, system memory may also include an operating system, application programs, other program modules, and program data. The disclosed system may be used in an embodiment of a peristaltic pump.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device, where the instructions are executed by a processor. In the context of this document, a storage device is not a signal and "non-transitory" includes all media except signal media.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and products according to various example embodiments. It will be understood that the actions and functionality may be implemented at least in part by program instructions. These program instructions may be provided to a processor of a device, e.g., a hand held measurement device, or other programmable data processing device to produce a machine, such that the instructions, which execute via a processor of the device, implement the functions/acts specified.

It is noted that the values provided herein are to be construed to include equivalent values as indicated by use of the term "about." The equivalent values will be evident to those having ordinary skill in the art, but at the least include values obtained by ordinary rounding of the last significant digit.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A method for moving precise volumes of fluid using a linear peristaltic pump, comprising:

operating the pump for a first portion of a single rotation of a pump cycle of a cam, wherein the operating the first portion dispenses a first reagent delivered in a first delivery tube contacted by a first set of lobes on the cam, wherein the pump comprises a motor and the cam;

pausing the pump for a period of time; and operating the pump for a second portion of the single rotation of the pump cycle of the cam, wherein the operating the second portion dispenses a second reagent contained in a second delivery tube contacted by a second set of lobes on the cam, wherein the sum of the first and second portions is selected from the group consisting of: a full rotation of the cam and less than a full rotation of the cam.

2. The method of claim 1, wherein the first reagent comprises one or more reagents.

3. The method of claim 1, wherein the second reagent comprises one or more reagents.

4. The method of claim 1, further comprising an additional portion of the pump cycle, wherein the sum of the first portion of the pump cycle, the second portion of the pump cycle, and the additional portion of the pump cycle is selected from the group consisting of: a full rotation of the cam and a less than full rotation of the cam within the pump.

5. The method of claim 1, wherein the period of time correlates to a time for a chemistry of a reaction.

6. The method of claim 5, wherein the period of time allows for development of a color for a colorimeter measurement.

7. The method of claim 1, further comprising an additional pause and operating the pump for an additional portion of the pump cycle, wherein the operating the additional portion dispenses a third reagent.

8. The method of claim 1, wherein the first reagent and the second reagent each has separate delivery tubes associated with a different set of lobes on the cam.

9. The method of claim 1, wherein the motor comprises a stepper motor.

10. The method of claim 1, wherein the pump delivers reagents to a water sample for a measurement parameter.

11. A device for delivering a precise volume of fluid using linear peristaltic pump, comprising:

a motor;

a cam;

a motor controller;

a processor;

a memory device that stores instructions that, when executed by the processor, causes the system to:

operate the pump, using the motor controller, for a first portion of a single rotation of a pump cycle of a cam, wherein the operating the first portion dispenses a first reagent delivered in a first delivery tube contacted by a first set of lobes on the cam;

pause the pump, using the motor controller, for a period of time; and operate the pump, using the motor controller, for a second portion of the single rotation of the pump cycle of the cam, wherein the operating the second portion dispenses a second reagent contained in a second delivery tube contacted by a second set of lobes on the cam, wherein the sum of the first and second portions is selected from the group consisting of: a full rotation of the cam and less than a full rotation of the cam.

12. The device of claim 11, wherein the first reagent comprises one or more reagents.

13. The device of claim 11, wherein the second reagent comprises one or more reagents.

14. The device of claim 11, further comprising an additional portion of the pump cycle, wherein the sum of the first portion of the pump cycle, the second portion of the pump cycle, and the additional portion of the pump cycle is selected from the group consisting of: a full rotation of the cam and a less than full rotation of the cam within the pump.

15. The device of claim 11, wherein the period of time correlates to a time for a chemistry of a reaction.

16. The device of claim 15, wherein the period of time allows for development of a color for a colorimeter measurement.

17. The device of claim 11, further comprising an additional pause and operating the pump for an additional portion of the pump cycle, wherein the operating the additional portion dispenses a third reagent.

18. The device of claim 11, wherein the first reagent and the second reagent each has separate delivery tubes associated with a different set of lobes on the cam.

19. The device of claim 11, wherein the motor comprises a stepper motor.

20. A non-transitory computer-readable storage device that stores executable code that, when executed by one or more processors, causes the one or more processors:

control a linear peristaltic pump to dispense a first reagent delivered in a first delivery tube contacted by a first set of lobes on a cam for a first portion of a single rotation of a pump cycle of the cam;

pause the linear peristaltic pump for a period of time; and control the linear peristaltic pump to dispense a second reagent contained in a second delivery tube contacted by a second set of lobes on the cam for a second portion of the single rotation of the pump cycle of the cam, wherein the sum of the first and second portions is selected from the group consisting of: a full rotation of the cam and less than a full rotation of the cam.

* * * * *